US005135271A

United States Patent [19]

Bestwick

[11] Patent Number: 5,135,271

[45] Date of Patent: Aug. 4, 1992

[54] LATCHING APPARATUS FOR ACCESS COVERS ON BULK STORAGE STRUCTURES

[75] Inventor: Ronald D. Bestwick, Taylorville, Ill.

[73] Assignee: Grain Systems, Inc., Assumption, Ill.

[21] Appl. No.: 715,436

[22] Filed: Jun. 14, 1991

[51] Int. Cl.[5] ..... E05C 9/18

[52] U.S. Cl. ..... 292/218; 292/341.19; 292/DIG. 72; 49/465

[58] Field of Search ..... 292/218, 304, 341.18, 292/341.19, 259, 213, 241, DIG. 72; 49/414, 463, 465

[56] References Cited

U.S. PATENT DOCUMENTS

| | | | |
|---|---|---|---|
| 2,767,008 | 10/1956 | Oswald | 292/241 |
| 3,039,837 | 6/1962 | Poe | 292/241 X |
| 3,081,118 | 3/1963 | Krause | 292/304 X |
| 3,416,829 | 12/1968 | Russell et al. | 292/341.19 |
| 4,913,478 | 4/1990 | Grossman | 292/259 |

*Primary Examiner*—Richard E. Moore
*Attorney, Agent, or Firm*—Polster, Lieder, Woodruff & Lucchesi

[57] ABSTRACT

An improved latching apparatus for an access opening cover member or door on a grain bin. When locked closed, the cover member engages the adjacent wall of the grain bin to integrate the cover member with the grain bin wall to thereby enable hoop stresses caused by the weight of grain being stored in the bin to pass through the cover member. Typically, a series of pins carried by the door frame engages openings in the edges of the cover member or door to structurally integrate the door into the bin. The integration of the cover member with the bin wall provides a greater structural integrity of the bin and cover member; however, due to the stresses placed upon the cover member and bin wall, the pins tend to bind, making it difficult to disengage and open the cover member. In order to help disengage the cover member from the adjacent bin wall, the latching apparatus includes cam means for providing a mechanical advantage to force the cover member out of engagement with the pins and thereby permit the cover member to open with reduced effort. Improved pin structure is also disclosed.

14 Claims, 2 Drawing Sheets

LATCHING APPARATUS FOR ACCESS COVERS ON BULK STORAGE STRUCTURES

BACKGROUND OF THE INVENTION

The invention relates to an improved latching apparatus for closing and opening a cover door used for closing an access opening in a bulk storage structure such as a grain bin wherein the structure and cover door will be exposed to significant forces exerted thereon by the weight of the material being stored therein.

In order to improve the structural integrity of such a bulk storage structure, it has been suggested in U.S. Pat. No. 4,913,478, the disclosure of which is incorporated herein by reference thereto, that the cover member be supplied with a plurality of bores which engage with respective protuberances or pins on the storage structure adjacent the access opening. Thus, as hoop stresses are applied to the storage structure by the weight of the material being stored, the hoop stresses can pass through the cover member by means of the tensile force exerted between a structure protuberance and a respective cover member bore.

It has been discovered, however, that when the aforementioned hoop stresses are applied to the storage structure with an engaged or integrated cover member, slight deformations occur in the structures which cause the cover bores to bind or stick on the protuberances thereby causing great difficulty in disengaging the protuberances from the bores and preventing facile opening of the cover member. In some cases it has been necessary to use a sledge hammer or the like to ram the cover member open. This procedure, of course, may cause permanent damage to the cover member or the adjacent jamb requiring expensive replacement or repair, and cause the entire storage structure to be unusable for a significant period of time.

SUMMARY OF THE INVENTION

It is therefore an object of the invention to provide an improved storage structure access opening cover member latching apparatus having improved integrating means for integrating the cover member with the storage structure when the cover member is closed, and which includes means for forcing the cover member out of engagement with the integrating means when the cover member is to be opened.

It is a further object of the invention to provide an improved latching apparatus which is simple and inexpensive to manufacture and operate and which provides a significant mechanical advantage in causing the cover member to disengage from the integrating means of the storage structure without damaging the structures.

Generally speaking, the latching apparatus of the present invention comprises a releasable securement of a cover member over an access opening in a bulk storage structure. The bulk storage structure includes improved pin structure for engaging the cover member when the cover member is in a closed position to thereby enable hoop stresses placed upon the storage structure to pass through the cover member. The latching apparatus includes latch means associated with the cover member pivotable between a locking position and an unlocking position. The improvement comprises means, such as a cam surface on the latch means which forces the cover member out of engagement with the integrating structure as the latch means is pivoted from the locking position toward the unlocking position.

These, as well as other, objects and advantages of the instant invention will become more apparent upon a reading of the following detailed description of a preferred embodiment thereof in conjunction with the drawings, wherein:

DETAILED DESCRIPTION OF A PREFERRED EMBODIMENT

Figure 2:
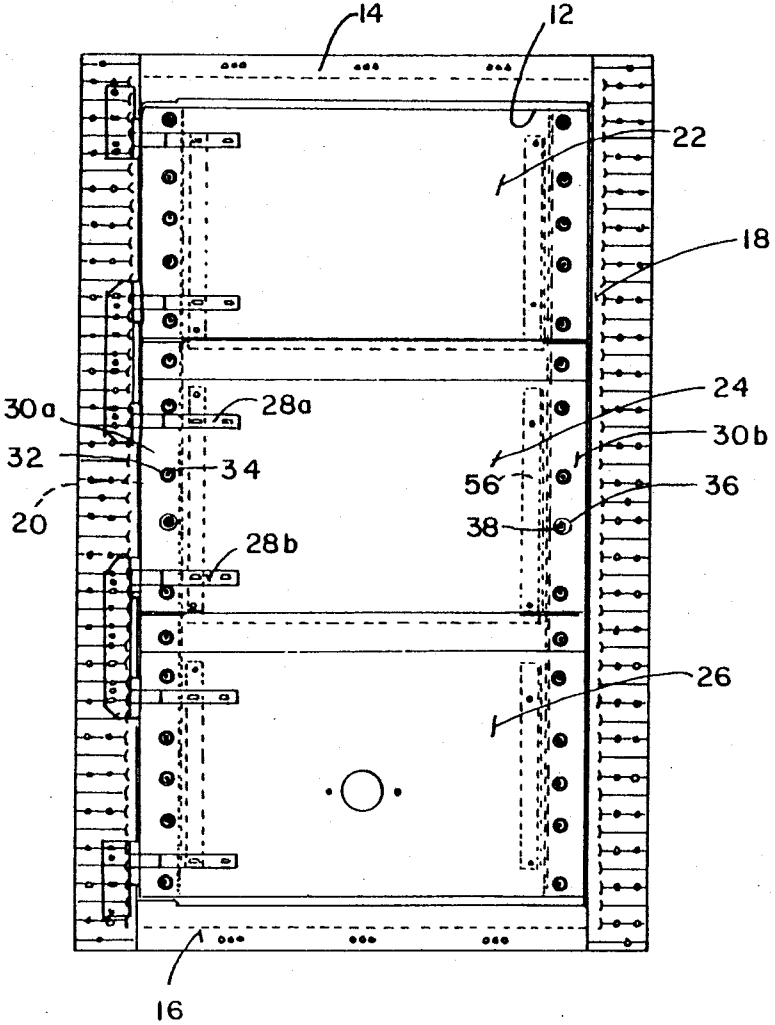
FIG. 2 a rear elevational view of the grain bin access opening cover assembly showing the cover assembly in a closed position as viewed from the inside of the grain bin.
Figure 1:
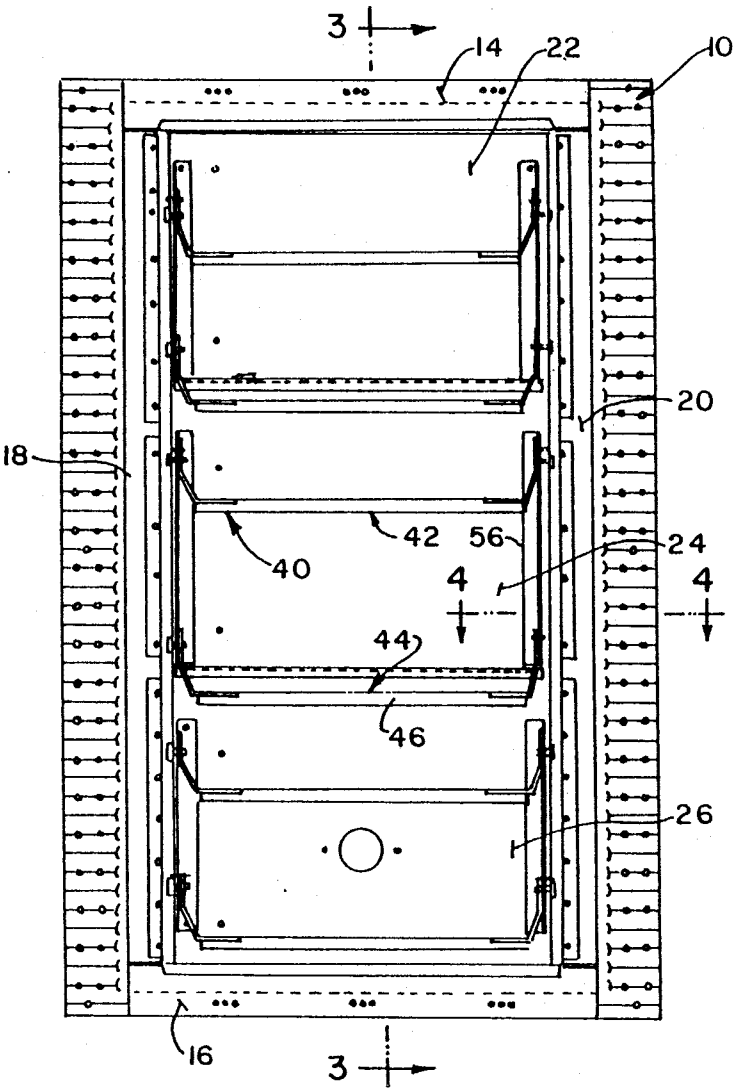
FIG. 1 is a front elevational view of a grain bin access opening cover assembly showing the cover assembly in a closed position as viewed from the outside of the grain bin.

In order to place the preferred embodiment in proper context, reference is initially made to FIGS. 1 and 2 of U.S. Pat. No. 4,913,478 which shows a bulk storage structure, commonly referred to as a grain bin which is typically constructed with a generally cylindrical wall of corrugated sheet metal. The grain bin includes a rectangular access opening which may be closed first by a plurality of vertically stacked, inner cover members and then by an outer security door.

Now, with particular reference to FIGS. 1 and 2 of the present drawings, there is shown a grain storage bin 10 having a generally rectangular access opening 12 defined by top door jamb member 14, bottom door jamb member 16 and vertical side door jambs 18 and 20. Access opening 12 is shown closed by three vertically stacked inner cover members 22, 24, 26. Cover members 22, 24, 26 are virtually identical in construction and do not differ in any respect which affects the description of the present invention; therefore, a detailed description of only middle cover member 24 will be presented.

Cover member 24 is constructed of sheet metal and is swingedly moveable from the closed position shown to an open position by means of hinge pair **28*a*, 28*b* connected between cover member 24 and bin 10 such that cover member 24 may swing open into bin 10. Cover member 24 includes vertically extending side portions 30*a*, 30*b* which overly respective door jambs 20 and 18 when cover member 24 is in the closed position. Side portion 30*a* is provided with a plurality of vertically spaced bores 32 which each receive therein respective inwardly extending vertically spaced protuberances 34 fixed to door jamb 20. Side portion 30*b*** is likewise provided with a plurality of vertically spaced bores 36 which each receive therein respective inwardly extending vertically spaced protuberances 38. Each of protuberances 34, 38 are preferably generally cylindrical with a chamfered free end and a main body diameter only slightly less than the diameter of bores 32, 36.

As is readily apparent, according to this construction, when cover member 24 is in a fully closed position; hoop stresses exerted upon bin 10 by the weight of granular material stored therein will act to attempt to expand the diameter of bin 10 and a lateral tension force will act upon cover member 24 urging side portions 30*a*, 30*b* of cover member 24 away from respective door jambs 20 and 18; however, protuberances 34, 38 located in bores 32, 36 will prevent any significant bowing or separation of door jambs 18, 20 from cover member 24. It should be understood, however, that, while no significant deformation of bin 10 or cover member 24 may be observed, it is quite often the case that when bin 10 is full of material, the forces placed upon bin 10 and cover member 24 may cause slight deformations which in turn cause protuberances 34, 36 to stick or jamb in their respective bores. This condition makes it very difficult to initiate the opening of cover member 24 after the bin is sufficiently emptied of stored material.

Cover member 24 includes a latching apparatus, generally referred to by reference numeral 40, mounted on the exterior of cover member 24 and door jambs 18, 20. Latching apparatus 40 is comprised of an upper latch assembly 42 and a lower latch assembly 44. As latch assemblies 42 and 44 are identical for purposes of describing the invention, only a detailed description of latch assembly 44 will follow.

Figure 4:
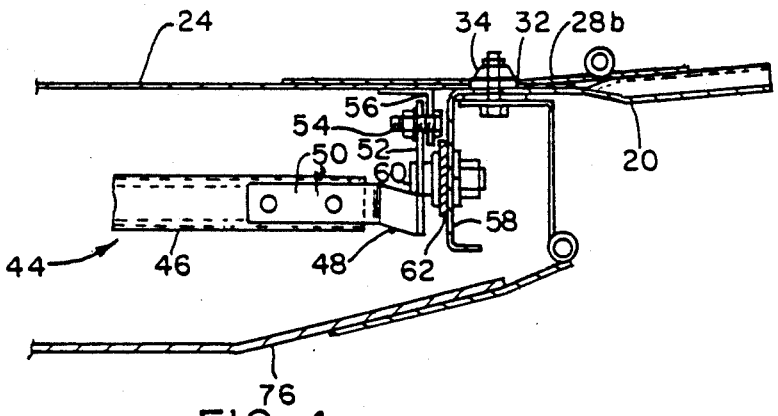
FIG. 4 is an enlarged partial cross-sectional view taken generally along reference line 4—4 of FIG. 1.
Figure 3:
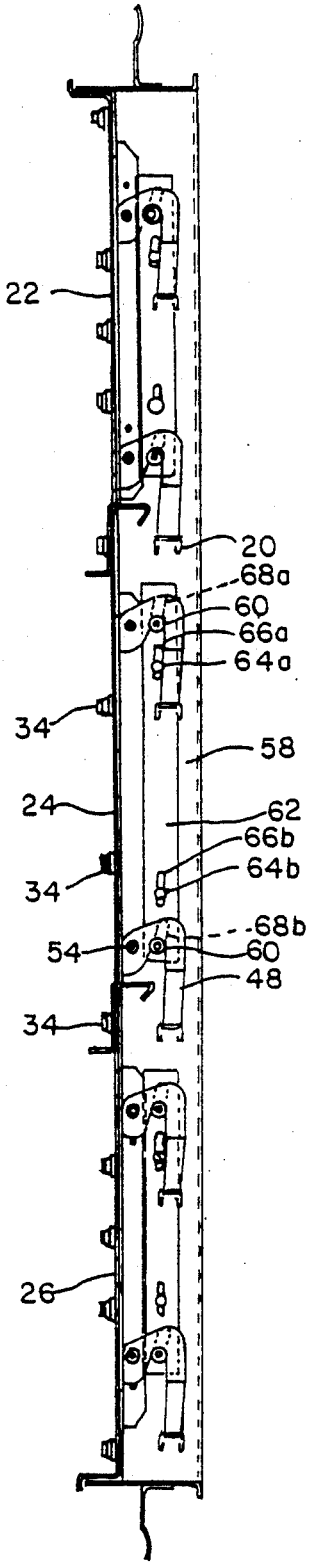
FIG. 3 is an enlarged cross-sectional view of the cover assembly taken generally along reference line 3—3 of FIG. 1.

As best seen in FIGS. 1, 3 and 4, latch assembly 44 includes a horizontal latch bar 46 which extends across the major extent of the lateral dimension of cover member 24 and is fixed at each end to a latch member 48. While it can readily be seen in FIG. 1 that each cover member 22, 24, 26 has associated therewith two latch bars and each latch bar is affixed to two laterally spaced latch members, the configuration and operation of each latch member and its associated constructions are virtually the same except that latch members on one side of cover member 24 are mirror images of latch members on the opposite side. Therefore, only the configuration and operation of latch member 48 and its associated structures will be described in detail.

Latch member 48 is fabricated from formed sheet metal and includes a horizontal latch bar attachment portion 50 attached to latch bar 46 and a vertically extending, generally hook-shaped portion 52. Latch member 48 is pivotally attached to pivot pin 54 which is held in pivot receptacle bracket 56 which is fixed to cover member 24.

As best seen in FIG. 4, door jamb 20 is formed with an outwardly extending catch bracket portion 58 which includes horizontally extending slots (not shown) for the passage therethrough of catch member 60. Mounted upon catch bracket portion 58 of door jamb 20 is a vertically extending catch adjustment bracket 62 which is attached by set screws 64*a*, 64*b*. Set screws 64*a*, 64*b* pass first through respective vertical slots 66*a*, 66*b* in adjustment bracket 62 and then into fixed holes (not shown) in bracket portion 58 of door jamb 20. Thus, it can be seen that adjacent bracket 62 may be adjusted slightly up or down before tightening set screws 64*a*, 64*b*. Also formed in adjustment bracket 62 are angled slots 68*a*, 68*b* through which catch member 60 extends and which restrict horizontal movement of catch member 60 passing therethrough. As adjustment bracket 62 is moved down, it can be seen that catch 60 will move slightly away from cover member 24. As adjustment bracket 62 is moved up, catch 60 will move slightly toward cover member 24 within the horizontal slot (not shown) in bracket portion 58. Thus, adjustment bracket 62 will provide precise positioning of catches 60 for proper operation of latch assembly 44 as will be explained hereinafter.

Figure 5:
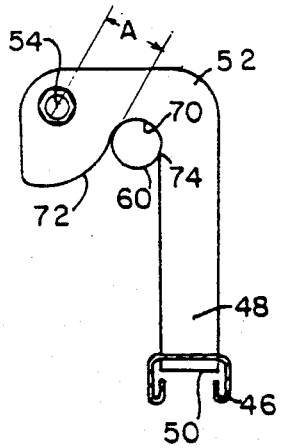
FIG. 5 is a diagrammatic view of a latch constructed according to the invention shown in a closed and locked position.
Figure 6:
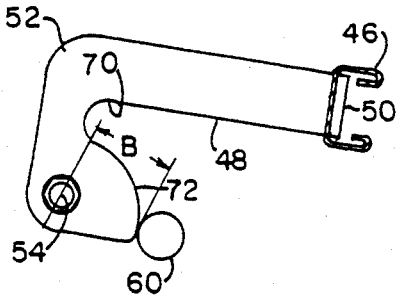
FIG. 6 is a diagrammatic view, similar to FIG. 5, showing the latch in an open and unlocked position.
Figure 7:
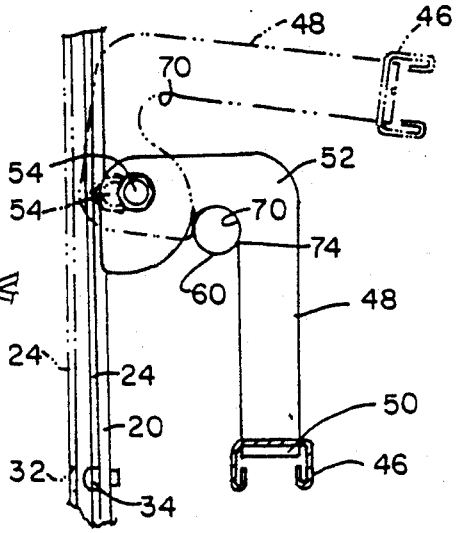
FIG. 7 is a diagrammatic view of the latch showing the forced movement of a cover member caused by the pivotal movement of a latch.

With particular reference to FIGS. 5–7, it is seen that hook-shaped portion 52 of latch member 48 includes hooked catch receptacle portion 70 and a sloping cam surface portion 72. Sloping cam surface portion 72 is configured such that the dimension A, from pivot pin 54 to surface 72 adjacent catch receptacle portion 70, is less than dimension B, from pivot pin 54 to surface 72 spaced from receptacle portion 70. Receptacle portion 70 includes a slight protrusion 74 which will act to hold catch 60 in receptacle portion 70 when latch member 48 is in the closed and locked position as shown in FIG. 5.

Figure 8:
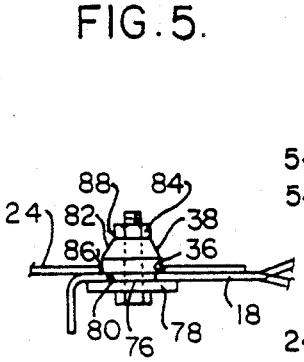
FIG. 8 is an enlarged cross-sectional view taken generally along line 8—8 of FIG. 2 showing the improved pin structure according to the invention.

FIG. 8 details the structure of the improved pins 34, 38 which help integrate the wall of storage structure 10 with cover members 22, 24, 26. As all of the pins are constructed alike, only the structure of one pin 38 is detailed. Pin 38 is comprised of a threaded bolt 76 which extends through a cap bar or washer 78, and through an enlarged hole 80 in door jamb 18 which is substantially larger than the diameter of bolt 76. A load transfer pin member 82 is secured in place on bolt 76 and the bolt is preloaded or tensioned by a threaded nut 84. Specifically, nut 84 is tightened on bolt 76 to a predetermined torque level thereby to preload the bolt in tension and to tightly draw the base of pin member 82 and cap bar 78 into firm frictional engagement with jamb 18 held therebetween. In this manner, loads between the jamb 18 and the cover members are substantially transferred by the frictional engagement of the pin member and the cap bar with jamb 18, and not by bolt 76 bearing against the edge of enlarged hole 80. It will be appreciated that, in this manner, bolt 76 is loaded only in tension due to its preload and the bolt is not subjected to substantial shear. This has the effect of increasing the load-carrying capability of improved pin means 34, 38 of the present invention.

Pin member 82 includes a generally cylindrical body portion 86 and an inwardly extending tapered portion 88. The diameter of cylindrical body portion 86 is only slightly less than the diameter of bore 36 to provide a snug fit between body portion 86 and bore 36. The diameter of the portion of bolt 76 which passes through hole 80 in door jamb 18 is substantially less than that of hole 80 so that the shear forces, as heretofore described, exerted between storage structure jamb 18 and cover member 24 will not act to shear bolt 76. It is also noted that pin member 82 may be internally threaded and tapered portion 88 notched to allow torquing of pin member 82 by a tool such as a wrench to thereby eliminate the need for nut 84.

In operation, bottom cover member 26 is first closed and latched, then middle cover member 24 and thereafter top cover member 22. In each case latch bar 46 is lifted upwardly and pulled outward such that the associated cover member closes the access opening and the associated protuberances 34, 38 on door jamb 30*a*, 30*b* pass through and are captured within bores 32, 36 in the cover members. Latch bar 46 is then pushed downward until catch 60 passes over protrusion 74 and is lockingly received within catch receptacle portion 70 of latch member 48. It is noted that catch 60 has previously been positioned the proper distance away from pivot pin 54 by vertical movement and setting of adjustment bracket 62 to provide a secure locking closure by the combination of protrusion 74 and the tensile closing force placed upon cover member 24 when pulled shut on door jambs 30*a*, 30*b*. When all cover members 22, 24, 26 are latched in a closed and locked position, outer security door 76 (FIG. 4) is closed and locked. When it is desired to open one or more of cover members 22, 24, 26 security door 76 is opened and the cover members may be unlatched in order from top cover member 22 to bottom cover member 26. To unlatch, for example, latch assembly 44, latch bar 46 is pulled and raised upwardly first to pass catch member 60 over protrusion 74 and thereby free catch member 60 from catch receptacle portion 70. Thereafter, cam surface 72 will abut catch 60 as latch bar 46 is being raised. As the sloping cam surface 72 of latch member 48 is moved along catch 60 by the mechanical advantage obtained by the lever action of latch member 48, pivot point 54 will necessarily move inwardly away from catch 60 to thereby force cover member 24 inwardly of bin 10 and away from binding engagement with protuberances 34, 38. Thus, as best seen in FIG. 7 as latch bar 46 is moved upwardly to the open, unlocked position, cover member 24 will necessarily move open and be freed from the binding or sticking of cover member 24 on protuberances 34, 38, which has been a bothersome problem in the past as explained hereinabove.

Inasmuch as numerous changes or modifications may be made to the preferred embodiment of the invention as described in detail hereinabove without departing from the spirit and scope of the invention, for example, only one latch member having a cam surface may be used per latch bar, or the latch members positioned adjacent the cover member hinges may have a reduced dimension B as compared with the latch members positioned on the opposite side of the cover members in order to exert an even force on the cover members as they swing open on the hinges; it is therefore specifically noted that the scope of the invention is to be determined solely by the language of the following claims.

What is claimed is:

1. An improved latching apparatus for releasably securing a cover means over an access opening in a bulk storage structure, said bulk storage structure including integrating means for engaging said cover means when said cover means is in a closed position to pass hoop stresses placed upon said storage structure through said cover means, said latching apparatus including latch means associated with said cover means and pivotable between a locking position and an unlocking position, the improvement comprising:

said latching apparatus including means for forcing said cover means out of engagement with said integrating means as said latch means is pivoted from said locking position toward said unlocking position.

2. The improved latching apparatus as specified in claim 1 and further comprising:

latch catch means on said storage structure adjacent said access opening, said latch means including hook means for engaging said catch means when said latch means is in said locking position, and said latch means carrying cam means which abuts said catch means as said latch means is pivoted from said locking position toward said unlocking position.

3. The improved latching apparatus as specified in claim 2 wherein:

said cam means pivots with said latch bar means about a pivot point positioned a predetermined distance from said catch means;

said cam means having a curved surface which slopes an increasing distance from said pivot point such that said surface does not abut said catch means when said latch means is in said locking position and said surface abuts said catch means as said latch means is pivoted toward said unlocking position to force said pivot point increasingly away from said catch means to thereby force said cover means away from said catch means and out of engagement with said integrating means.

4. The improved latching apparatus as specified in claim 3 wherein:

said latch means includes at least one latch bar assembly including a first latch member pivotably positioned on a first lateral side of said cover member and a second latch member pivotably positioned on a second lateral side of said cover member opposite said first side, and an elongated latch bar extending between said first and second latch members such that said first and said second latch members will move in unison with said latch bar.

5. The improved latching apparatus as specified in claim 4 wherein:

said cover means includes at least one cover member and at least one of said latch bar assemblies is operatively associated with said at least one cover member.

6. The improved latching apparatus as specified in claim 5 wherein:

said cover means includes a plurality of vertically stacked cover members and each of said cover members has two latch bar assemblies associated therewith.

7. The improved latching apparatus as specified in claim 2 and further comprising:

means on said storage structure for adjusting the position of said latch catch means.

8. The improved latching apparatus as specified in claim 7 herein:

said means for adjusting said catch means includes a vertically adjustable adjustment bracket having vertical slots through which pass set screws and said bracket having angled slots through which pass said catch means, such that vertical movement of said bracket will cause horizontal repositioning of said catch means.

9. A latching apparatus for releasably securing a cover member over an access opening in a bulk storage structure which structurally integrates the cover member into the storage structure for improving the structural integrity of the storage structure, said latching apparatus comprising:

integrating means on said bulk storage structure for releasably and retainably engaging said cover member to integrate said cover member with said storage structure when said cover member is in a closed position to thereby transmit forces exerted on said storage structure through said cover member;

latch means pivotally connected to said cover member;

catch means on said storage structure adjacent said access opening for engaging said latch means and locking said cover member in a closed position; and said latch means including cam means for abutting a portion of said storage structure after said latch means is pivoted out of locking engagement with said catch means to force said cover member to release from said integrating means on said storage structure, to thereby permit said cover member to move toward an open position and allow said access opening to be fully opened.

10. An improved latching apparatus for releasably securing a cover member to removably close an access opening in a bulk storage structure, said cover member being removably integratable into said storage structure to improve the structural integrity of the storage structure, said latching apparatus comprising cover protuberant means engaging bores formed on an abutting surface of said cover member; cover protuberant means attached to said storage structure for releasably engaging said cover protuberant means engaging bores, hinge means attached to said cover member and to said storage structure for hingedly connecting said cover member to said storage structure pivot receptacle means attached to said cover member for pivotally attaching latch bar means to said cover member; said latch bar means being operationally attached to said pivot receptacle means for providing a mechanical advantage in closing said cover member over said access opening; and latch protuberant means mounted to an edge of said access opening for engaging said latch bar means when closing said cover member over said access opening and for retaining said cover member thereover; the improvement comprising:

said latching apparatus including means for forcing said cover protuberant means engaging bores out of engagement with said cover protuberant means as said latch bar means is pivoted out of engagement with said latch protuberant means and for providing a mechanical advantage in opening said cover member.

11. The improved latching apparatus as specified in claim 10 wherein:

said cover protuberant means are attached to said storage structure on an inside inwardly facing surface of said storage structure generally along the edges of said access opening.

12. The improved latching apparatus as specified in claim 11 wherein:

said cover protuberant means are a plurality of pins attached to said storage structure on an inwardly facing surface of said storage structure generally along the edges of said access opening.

13. The improved latching apparatus as specified in claim 12 wherein:

said pins are each comprised of a threaded bolt passing through a hole in said storage structure and a pin member positioned around said bolt such that said pin member is tightly engaged with a portion of the inside surface of said storage structure;

said pin member having a generally cylindrical body portion and an inwardly extending tapered nose portion;

the diameter of said cylindrical body portion being only slightly less than the diameter of a respective one of said bores to provide a snug fit between said body portion and said respective one of said bores; and the diameter of said bolt being less than the diameter of said hole in said storage structure to help relieve said bolt from shear forces exerted between said storage structure and said cover member.

14. An improved latching apparatus for releasably securing a cover member to removably close an access opening in a bulk storage structure, said cover member being removably integratable into said storage structure to improve the structural integrity of the storage structure, said latching apparatus comprising pin engaging bores formed on an abutting surface of said cover member; pins attached to said storage structure for releasably engaging said bores, hinge means attached to said cover member and to said storage structure for hingedly connecting said cover member to said storage structure; pivot receptacle means attached to said cover member for pivotally attaching latch bar means to said cover member; said latch bar means being operationally attached to said pivot receptacle means for providing a mechanical advantage in closing said cover member over said access opening; and latch protuberant means mounted on edge of said access opening for engaging said latch bar means when closing said cover member over said access opening and for retaining said cover member thereover; the improvement comprising:

said pins are each comprised of a threaded bolt passing through a hole in said storage structure and a pin member positioned around said bolt such that said pin member is tightly engaged with a portion of the inside surface of said storage structure;

said pin member having a generally cylindrical body portion and an inwardly extending tapered nose portion;

the diameter of said cylindrical body portion being only slightly less than the diameter of a respective one of said bores to provide a snug fit between said body portion and said respective one of said bores; and the diameter of said bolt being less than the diameter of said hole in said storage structure to help relieve said bolt from shear forces exerted between said storage structure and said cover member.

* * * * *